US006990405B2

(12) United States Patent
Nakamura

(10) Patent No.: US 6,990,405 B2
(45) Date of Patent: Jan. 24, 2006

(54) ENGINE CONTROL DEVICE

(75) Inventor: Michihisa Nakamura, Iwata (JP)

(73) Assignee: Yamaha Motor Company Ltd., (JP)

( * ) Notice: Subject to any disclaimer, the term of this patent is extended or adjusted under 35 U.S.C. 154(b) by 0 days.

(21) Appl. No.: 11/048,633

(22) Filed: Feb. 1, 2005

(65) Prior Publication Data

US 2005/0193979 A1 Sep. 8, 2005

Related U.S. Application Data

(63) Continuation of application No. PCT/JP03/04665, filed on Apr. 11, 2003.

(30) Foreign Application Priority Data

Aug. 1, 2002 (JP) ..... 2002-225159

(51) Int. Cl.
*F02D 45/00* (2006.01)

(52) U.S. Cl. ..... 701/114; 123/406.18

(58) Field of Classification Search ..... 701/114, 701/110, 115; 123/406.18; 73/116, 117.3
See application file for complete search history.

(56) References Cited

U.S. PATENT DOCUMENTS

| | | | | |
|---|---|---|---|---|
| 4,788,956 | A * | 12/1988 | Suzuki et al. | 701/114 |
| 6,840,224 | B2 * | 1/2005 | Tanabe et al. | 123/458 |
| 2001/0010218 | A1 | 8/2001 | Yamazaki et al. | |

FOREIGN PATENT DOCUMENTS

| | | |
|---|---|---|
| JP | 63-61754 A | 3/1988 |
| JP | 04-194345 | 7/1992 |
| JP | 8-30889 A | 1/1996 |
| JP | 10-227252 | 8/1998 |
| WO | PCT/JP03/04665 | 7/2003 |

* cited by examiner

*Primary Examiner*—Hieu T. Vo
(74) *Attorney, Agent, or Firm*—Knobbe Martens Olson & Bear LLP

(57) ABSTRACT

An engine control device is provided to reliably detect an abnormality in crank pulses. The device determines that there is an abnormality in crank pulses when the situation, in which a standard pitch crank pulse counter T does not reach a prescribed value $T_0$ between irregular pitch crank pulses (interval abnormality), repeatedly occurs at least a prescribed value $CNT_0$ times, when an irregular pitch is not detected for a prescribed period of time for the crank pulse counter T to count up to $T_{MAX}$ or longer, or when the situation, in which a prescribed number or more of clank pulses are not detected for a prescribed period of time, repeatedly occurs at least a count-up value $K_{MAX}$ of times.

8 Claims, 10 Drawing Sheets

$T_2/(T_1 + T_3) < \alpha$: JUDGMENT REGULAR PITCH
$T_2/(T_1 + T_3) > \alpha$: JUDGMENT IRREGULAR PITCH

ENGINE CONTROL DEVICE

RELATED APPLICATIONS

This is a Continuation of PCT application PCT/JP03/04665, which was filed on Apr. 11, 2003 and published in Japanese on Feb. 12, 2004 as WO 04/013479, and which is incorporated herein by reference. The above PCT application claims priority to Japanese Patent Application No. 2002-225159, filed Aug. 1, 2002.

BACKGROUND OF THE INVENTION

1. Field of the Invention

This invention relates to an engine control device for controlling an engine and, more specifically to an engine control device suitable for controlling an engine provided with a fuel injection device for injecting fuel.

2. Description of the Related Art

With the widespread use of fuel injection devices called injectors in recent years, control of fuel injection timing and fuel injection amount, namely, the air-fuel ratio, has become easy, which makes it possible to improve engine output and fuel consumption and to clean exhaust gas. As to the fuel injection timing, the phase state of a camshaft, that is the state of an intake valve, is commonly detected, and fuel injected based on the detected result. However, it is difficult to employ a cam sensor to detect the phase state of a camshaft, particularly in motorcycles, because it is expensive and increases the size of a cylinder head. To solve this problem, an engine control device adapted to detect the phase state of a crankshaft and an intake air pressure is proposed in JP-A-H10-227252. Based on the detection of the phase state and air intake pressure, the engine control device detects the stroke state of a cylinder. It is thus possible to detect the stroke state of a cylinder without detecting the phase of a camshaft, so that it is possible to control fuel injection timing based on the stroke state.

For example, the phase of a crankshaft is detected as follows. The crankshaft, or a member which is rotated in synchronization with the crankshaft, has teeth formed on an outer periphery thereof at equal intervals with an irregular interval part. Crank pulses are generated by a crank pulse generating means, such as a magnetic sensor, with the rotational movement of the teeth. A specific rotational position of the crankshaft corresponding to the irregular interval part of the teeth is detected based on the state of the crank pulses. The rotational angle, namely the phase, of the crankshaft can be detected based on, for example, the number of the crank pulses from the specific rotational position of the crankshaft. However, when the positional relation between the crank pulse generating means, such as a magnetic sensor, and the teeth is not appropriate, the crank pulses may not be properly generated. Crank pulses generated by crank pulse generating means, such as a magnetic sensor, are obtained by converting a current continuously varying as a sine curve into binary ON-OFF signals with a prescribed value. Thus, when the sensor is too close to the teeth, the pulses become long or no OFF-part is generated, and when the sensor is too far apart from the teeth, the pulses become short or no ON-part is generated. In addition, there is no specific conventional method for detecting an abnormal condition of the crank pulse generating means.

The present invention has been made to solve the above problems and it is, therefore, an object of the present invention to provide an engine control device which can reliably detect an abnormal condition of crank pulse generating means.

SUMMARY OF THE INVENTION

An engine control device in accordance with one embodiment of the invention comprises a crank pulse generating means that generates a pulse signal with a rotation of a crankshaft. Crankshaft phase detecting means detects the pulse signals generated by the crank pulse generating means as crank pulses and detects the phase of the crankshaft by detecting a specific rotational position of the crankshaft based on the crank pulses. Intake air pressure detecting means detects the intake air pressure in an intake pipe of an engine. Engine control means controls the operating condition of the engine based on the phase of the crankshaft that is detected by the crankshaft phase detecting means and the intake air pressure that is detected by the intake air pressure detecting means. Crank pulse abnormality detecting means determines that the crank pulse generating means is operating in an abnormal condition when at least one crank pulse is detected by the crankshaft phase detecting means and the specific rotational position of the crankshaft is not detected for a prescribed period of time or longer.

The engine control device in accordance with another embodiment of the invention is characterized in that the crank pulse abnormality detecting means determines that the crank pulse generating means is in an abnormal condition when the number of crank pulses detected while the crankshaft phase detecting means detects the specific rotational position of the crankshaft twice is not equal to a prescribed value.

DETAILED DESCRIPTION OF THE PREFERRED EMBODIMENT

Figure 1:
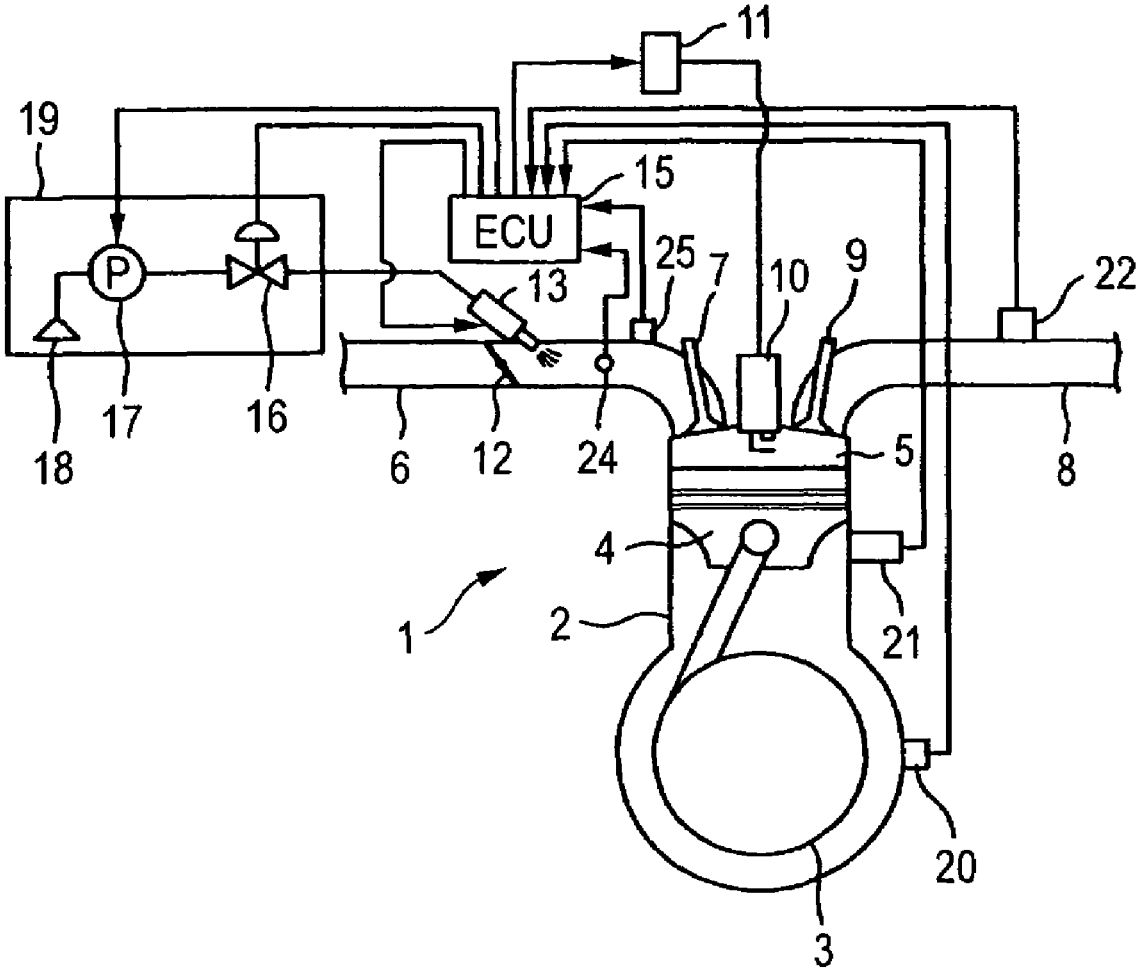
FIG. 1 is a schematic diagram of an engine for a motorcycle and a control device therefor.

FIG. 1 is a schematic diagram illustrating one embodiment of an engine 1 for a motorcycle or the like and a control device therefor. In the illustrated embodiment, the engine 1 is a four-cylinder, four-stroke engine. The engine 1 has a cylinder body 2, a crankshaft 3, a piston 4, a combustion chamber 5, an intake pipe 6, an intake valve 7, an exhaust pipe 8, an exhaust valve 9, a spark plug 10, and an ignition coil 11. A throttle valve 12 is disposed in the intake pipe 6 and is opened and closed in accordance with an accelerator position. A fuel injection device is preferably disposed downstream of the throttle valve 12. In the illustrated embodiment, the fuel injection device is an injector 13. The injector 13 is connected to a filter 18, a fuel pump 17 and a pressure control valve 16, all of which are preferably housed in a fuel tank 19. In one embodiment, the engine 1 employs an independent suction system, so that an injector 13 is provided in each intake pipe 6 of each cylinder.

The operation of the engine 1 is controlled by an engine control unit 15. In a preferred embodiment, the engine control unit 15 detects the operating condition of the engine 1 via input signals it receives from: a crank pulse generating means for generating crank pulses for use in detecting the rotational angle, or phase, of the crankshaft 3; a cooling water temperature sensor 21 for detecting the temperature of the cylinder body 2 or cooling water, namely the temperature of the engine body; an exhaust air-fuel ratio sensor 22 for detecting the air-fuel ratio in the exhaust pipe 8; an intake air pressure sensor 24 for detecting the pressure of intake air in the intake pipe 6; and an intake air temperature sensor 25 for detecting the temperature in the intake pipe 6, namely the temperature of intake air. In the illustrated embodiment, the crank pulse generating means is a crank angle sensor 20. Preferably, the engine control unit 15 receives detecting signals from the sensors 20, 21, 22, 24, 25 and communicates control signals to the fuel pump 17, the pressure control valve 16, the injector 13 and the ignition coil 11.

Figure 2:
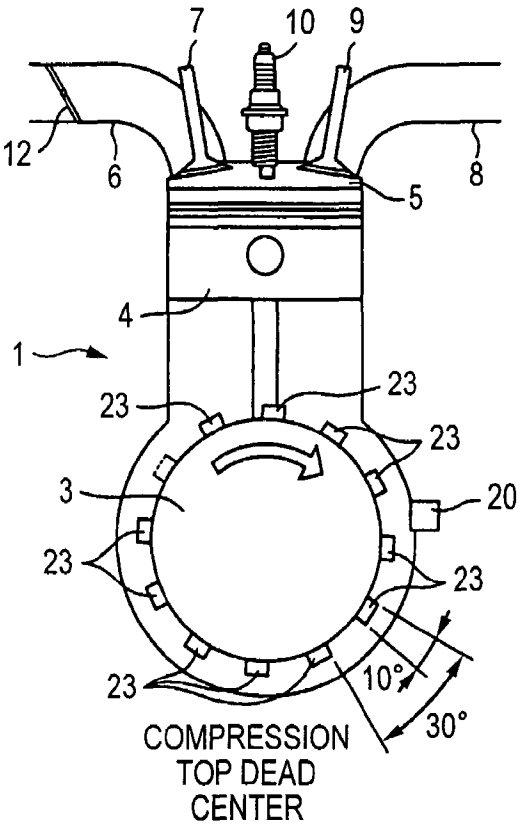
FIGS. 2(*a*)–(*b*) are explanatory views illustrating a principle of outputting crank pulses in the engine in FIG. 1.
Figure 2:
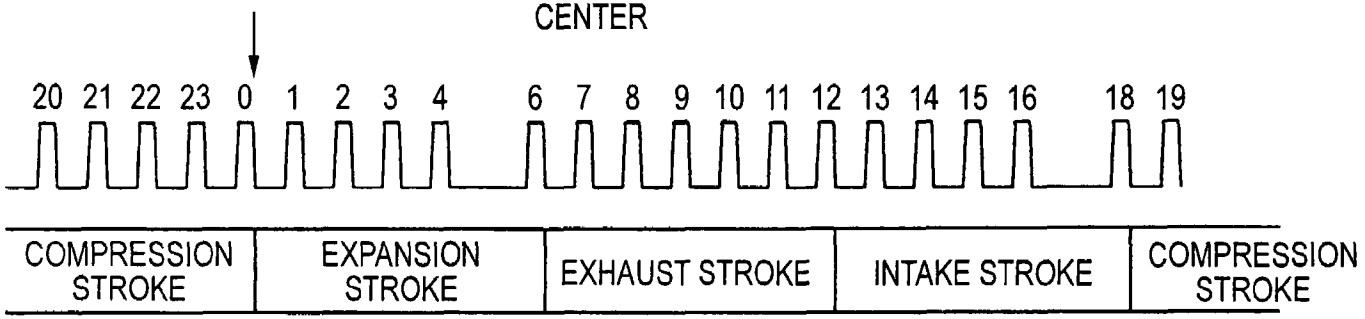

Here, the principle of crank angle signals which are generated by the crank angle sensor 20 will be described. In one embodiment, a plurality of teeth 23 are formed on an outer periphery of the crankshaft 3 at generally equal intervals as shown in FIG. 2*a*. The crank angle sensor 20, such as a magnetic sensor, detects the approach of the teeth 23, and the resulting current is electrically processed, namely binarized with a prescribed value, and outputted as pulse signals. In one embodiment, the circumferential pitch between two adjacent teeth 23 is approximately 30° in the phase (rotational angle) of the crankshaft 3, and the circumferential width of each of the teeth 23 is approximately 10° in the phase (rotational angle) of the crankshaft 3. Preferably, a location exists where two adjacent teeth are arranged not at the above pitch but at a pitch which is twice as large as the others. In one embodiment, said location is one where there is no tooth where there should be one, as shown by double-dot-dash lines in FIG. 2*a*. This location corresponds to an irregular interval part, namely a specific rotational position. This location may be hereinafter also referred to as the "missing tooth part". In the illustrated embodiment, when the crankshaft 3 rotates at a constant speed, the train of pulse signals corresponding to the teeth 23 appears as shown in FIG. 2*b*.

FIG. 2*a* shows the state where the piston 4 is at compression top dead center (the state is the same when the piston 4 is at exhaust top dead center). Preferably, the pulse signal generated immediately before the piston 4 reaches compression top dead center is numbered as "0", and the following pulse signals are numbered as "1", "2", "3" and "4". As shown in FIGS. 2*a* and 2*b*, the missing tooth part, which comes after the tooth 23 corresponding to the pulse signal "4", is counted as a tooth, as if one was present at the location, and the pulse signal corresponding to the next tooth 23 is numbered as "6". When this process is continued, the missing tooth part comes again after a pulse signal "16". The missing tooth part is again counted as one tooth as above, and the pulse signal corresponding to the next tooth 23 is numbered as "18". In the illustrated embodiment, when the crankshaft 3 has rotated twice, the four strokes of one cycle are then complete, so that the pulse signal corresponding to the next tooth 23 which appears after the pulse signal "23" is numbered as "0" again.

In principle, the piston 4 reaches compression top dead center immediately after the pulse signals numbered as "0" appear. Thus, the detected pulse signal train, or each pulse signal, is defined as a "crank pulse". When stroke detection is performed based on the crank pulse as described later, crank timing can be detected. In another embodiment, the teeth 23 may be formed on an outer periphery of a member that is rotated in synchronization with the crankshaft 3.

Figure 3:
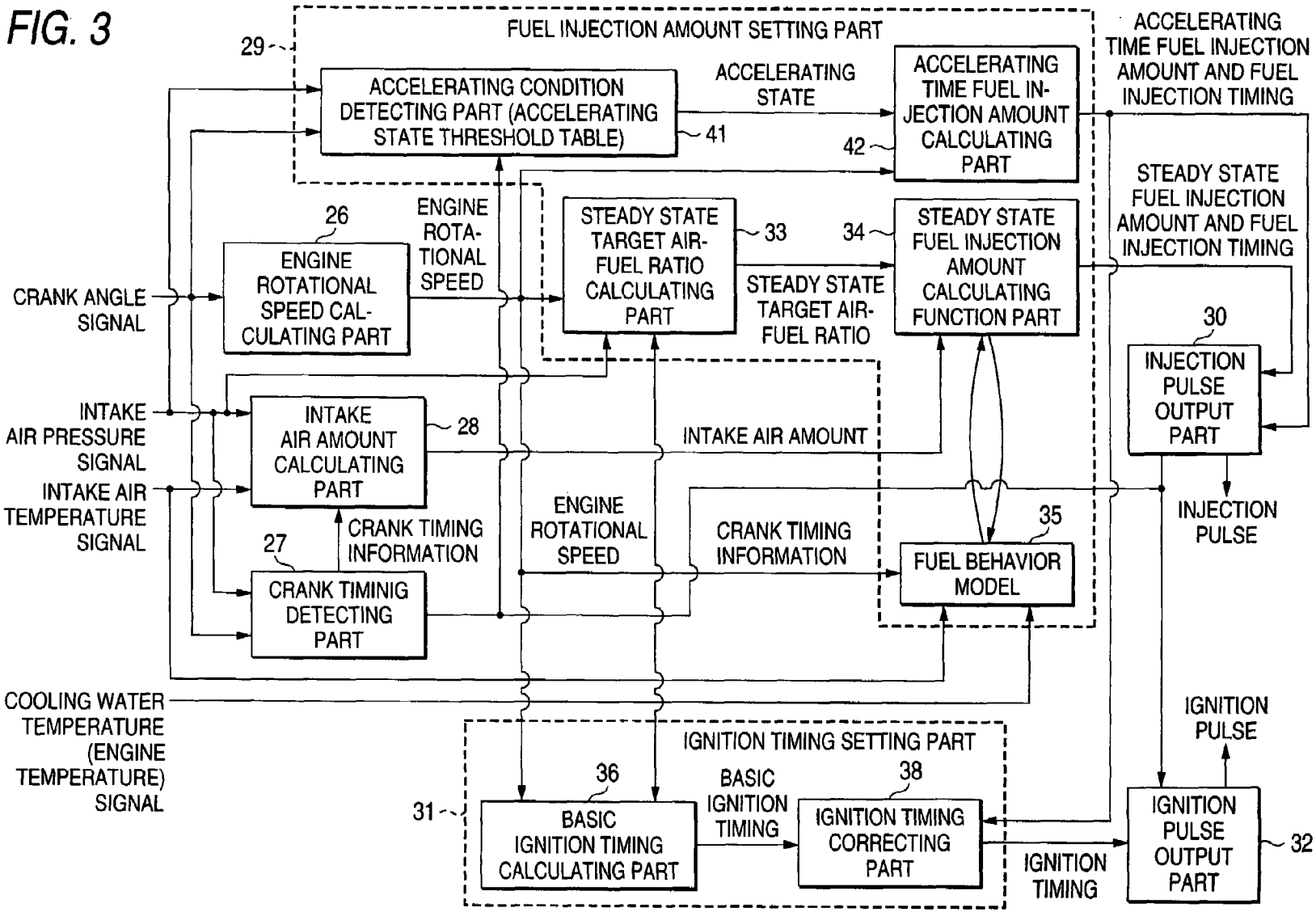
FIG. 3 is a block diagram illustrating one embodiment of the engine control device of the present invention.

In a preferred embodiment, the engine control unit 15 has a microcomputer (not shown) and so on. FIG. 3 is a block diagram illustrating an embodiment of the engine control operation performed by the microcomputer in the engine control unit 15. The engine control operation is performed by an engine rotational speed calculating part 26, which calculates the engine rotational speed based on a crank angle signal, a crank timing detecting part 27, which detects crank timing information, namely the stroke state, based on the crank angle signal and an intake air pressure signal, and an intake air amount calculating part 28, which calculates the amount of intake air based on the crank timing information detected by the crank timing detecting part 27 together with an intake air temperature signal and the intake air pressure signal. The engine control operation is also performed by a fuel injection amount setting part 29, which sets a target air-fuel ratio based on the engine rotational speed calculated in the engine rotational speed calculating part 26 and the intake air amount calculated in the intake air amount calculating part 28 and detects an accelerating state to calculate and set a fuel injection amount and fuel injection timing. The engine control operation is further performed by an injection pulse output part 30, which generates and communicates injection pulses corresponding to the fuel injection amount and the fuel injection timing set by the fuel injection amount setting part 29 to the injector 13 based on the crank timing information detected by the crank timing detecting part 27, an ignition timing setting part 31, which sets ignition timing based on the crank timing information detected by the crank timing detecting part 27 together with the engine rotational speed calculated in the engine rotational speed calculating part 26 and the fuel injection amount set by the fuel injection amount setting part 29, and an ignition pulse output part 32, which generated and communicates ignition pulses corresponding to the ignition timing set by the ignition timing setting part 31 to the ignition coil 11 based on the crank timing information detected by the crank timing information detecting part 27.

In a preferred embodiment, the engine rotational speed calculating part 26 calculates the rotational speed of the crankshaft, as an output shaft of the engine, as the engine rotational speed based on the rate of change of the crank angle signal with time. More specifically, the engine rotational speed calculating part 26 preferably calculates an instantaneous value of the engine rotational speed by dividing the phase between two adjacent teeth 23 by the time needed to detect corresponding crank pulses and an average engine rotational speed that is an average movement distance of the teeth 23.

Figure 4:
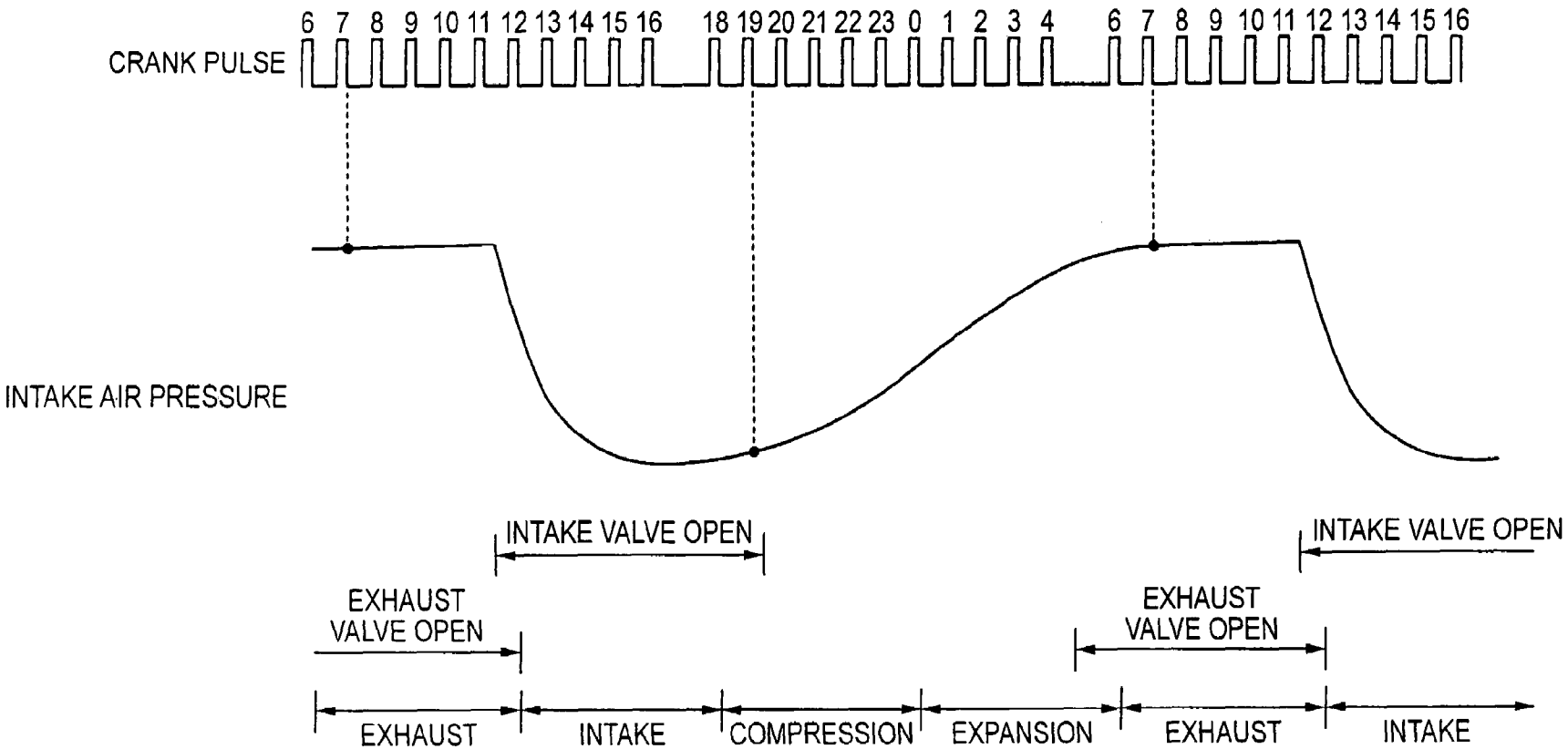
FIG. 4 is an explanatory view illustrating a process of detecting a stroke state based on the phase of a crankshaft and the intake air pressure.

The crank timing detecting part 27, which has a constitution similar to the stroke judging device disclosed in JP-A-H10-227252, detects the stroke state of each cylinder, as shown in FIG. 4 for example, and outputs it as crank timing information. Namely, in a four-cycle engine, the crankshaft and the camshaft are constantly rotated with a prescribed phase difference, so that when crank pulses are read as shown in FIG. 4, the fourth crank pulse after the tooth missing part, namely the crank pulse "9" or "21" represents either an exhaust stroke or a compression stroke. As is well known, during an exhaust stroke, the exhaust valve is opened and the intake valve is closed, so that the intake air pressure is high. However, in an early stage of a compression stroke, the intake air pressure is low because the intake valve is still open or because of the previous intake stroke, even if the intake valve is closed. Thus, the crank pulse "21" that is generated when the intake air pressure is low indicates that the piston 4 is on a compression stroke, and the piston 4 reaches compression top dead center immediately after the crank pulse "0" is obtained. Using the method for detecting a stroke state described above, the present stroke state can be detected in further detail by interpolating the intervals between the pulses with the rotational speed of the crankshaft. In a preferred embodiment, the stroke state of one of the cylinders, detected as described above, can be used to judge the stroke state of the other cylinders since there are prescribed phase differences between the strokes of the cylinders.

Figure 5:
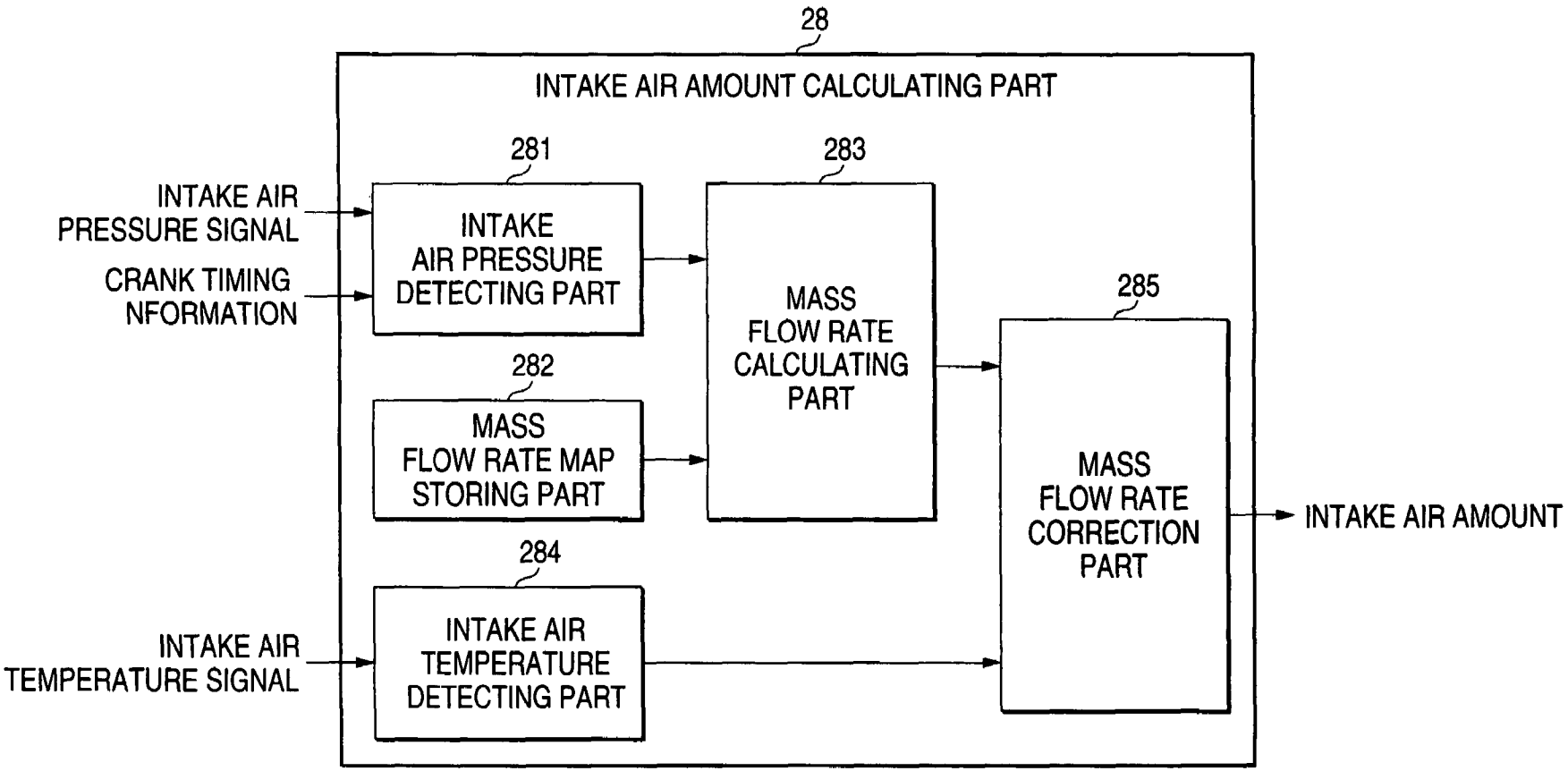
FIG. 5 is a block diagram of an intake air amount calculating part.

In the embodiment illustrated in FIG. 5, the intake air amount calculating part 28 includes an intake air pressure detecting part 281, which detects an intake air pressure based on an intake air pressure signal and crank timing information. A mass flow rate map storing part 282 stores a map for use in detecting a mass flow rate of intake air based on the intake air pressure. A mass flow rate calculating part 283 calculates a mass flow rate corresponding to the detected intake air pressure using the mass flow rate map. An intake air temperature detecting part 284 detects the intake air temperature based on an intake air temperature signal. Additionally, a mass flow rate correction part 285 corrects the mass flow rate of intake air based on the mass flow rate of intake air calculated in the mass flow rate calculating part 283 and the intake air temperature detected by the intake air temperature detecting part 284. Preferably, the mass flow rate map is organized based on a mass flow rate at an intake air temperature of about 20° C., so the map is corrected with an actual intake air temperature (absolute temperature ratio) to calculate the intake air amount.

In one embodiment, the intake air amount is calculated using an intake air pressure measured between the moment when the piston 4 reaches compression bottom dead center and the moment when the intake valve is closed. When the intake valve is opened, the intake air pressure and the pressure in the cylinder become almost the same. Thus, the air mass in the cylinder can be obtained from the intake air pressure, the volume in the cylinder and the intake air temperature. However, since the intake valve is open for a while after a compression stroke starts, and air can travel between the cylinder and the intake pipe during that time, the intake air amount calculated from an intake air pressure measured before the piston 4 reaches bottom dead center may differ from the air amount actually sucked into the cylinder. Thus, in a preferred embodiment the intake air amount is calculated using an intake air pressure measured while air cannot travel between the cylinder and the intake pipe, although the intake valve is open in a compression stroke. In one embodiment, the effect of the partial pressure of combusted gas may be taken into consideration, for further accuracy. Namely, since the partial pressure of combusted gas has close correlation with the engine rotational speed, a correction obtained in an experiment based on the engine rotational speed can be applied to the intake air amount.

Figure 6:
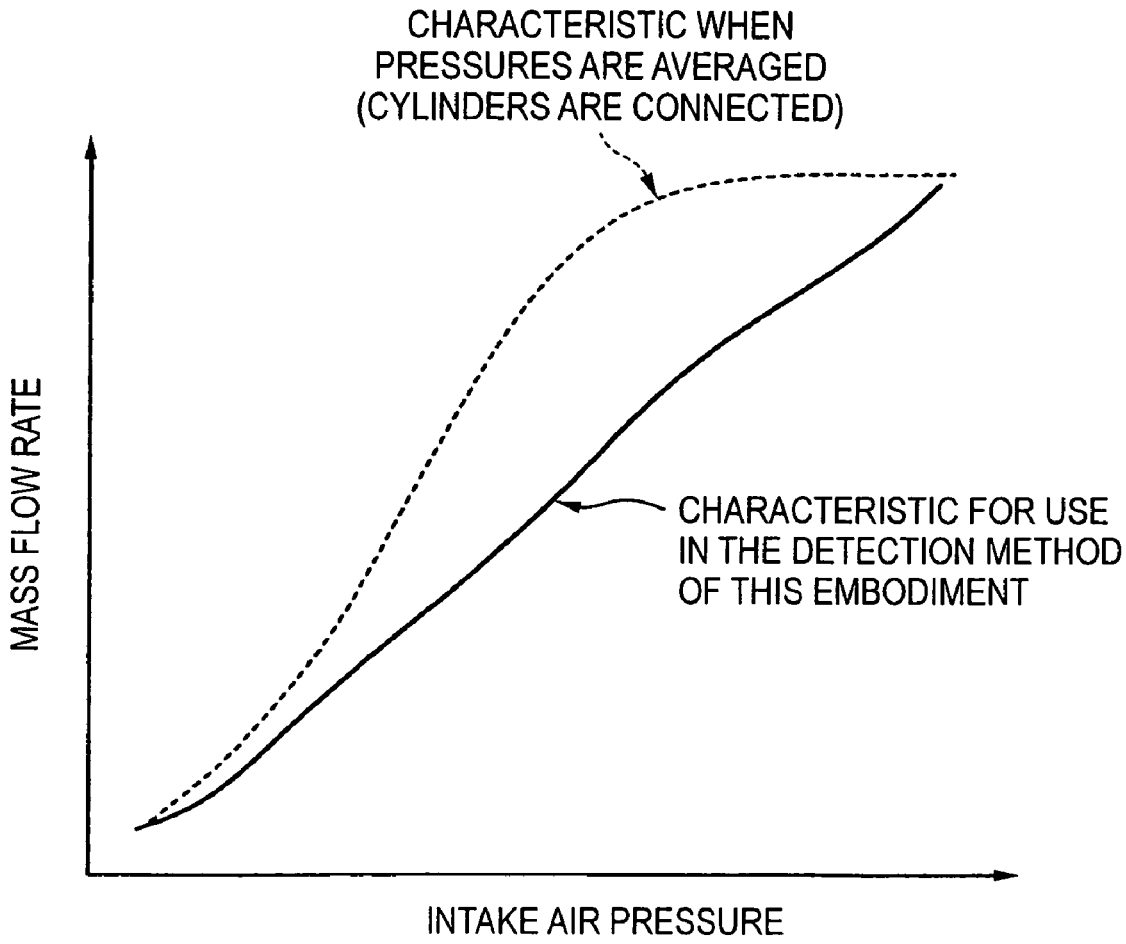
FIG. 6 is a control map for use in obtaining a mass flow rate of intake air from an intake air pressure.

In one embodiment employing an independent suction system, a map, in which the mass flow rate has a relatively linear relation with the intake air pressure, as shown in FIG. 6, is used as the mass flow rate map for use in calculating the intake air amount. In the illustrated embodiment, the air mass is obtained based on the Boyle-Charles law (PV=nRT). When the intake pipes of the cylinders are inter-connected, a map shown by a broken line in FIG. 6 must be used since the premise "intake air pressure=pressure in the cylinder" does not hold due to the effect of the pressures in the other cylinders.

In one embodiment, the fuel injection amount setting part 29 has a steady state target air-fuel ratio calculating part 33, which calculates a steady-state target air-fuel ratio based on an engine rotational speed calculated by the engine rotational speed calculating part 26 and an intake air pressure signal. A steady state fuel injection amount calculating part 34 calculates a fuel injection amount and fuel injection timing in the steady state based on the calculated steady state target air-fuel ratio and the intake air amount calculated in the intake air amount calculating part 28. The steady state fuel injection amount calculating part 34 preferably uses a fuel behavior model 35 in calculating the fuel injection amount and fuel injection timing. Additionally, accelerating state detecting means 41 detects an acceleration state based on a crank angle signal, an intake air pressure signal and crank timing information detected by the crank timing detecting part 27. Also, an accelerating time fuel injection amount calculating part 42 calculates a fuel injection amount and fuel injection timing during an acceleration state based on the engine rotational speed calculated in the engine rotational speed calculating part 26 in response to detection of an accelerating state by the accelerating state detecting means 41. Preferably, the fuel behavior model 35 is substantially integrated with the steady state fuel injection amount calculating part 34. Namely, without the fuel behavior model 35, it is impossible to calculate and set a fuel injection amount and fuel injection timing accurately in this embodiment, in which fuel is injected into the intake pipe. In one embodiment, the fuel behavior model 35 requires an intake air temperature signal, an engine rotational speed and a cooling water temperature signal.

Figure 7:
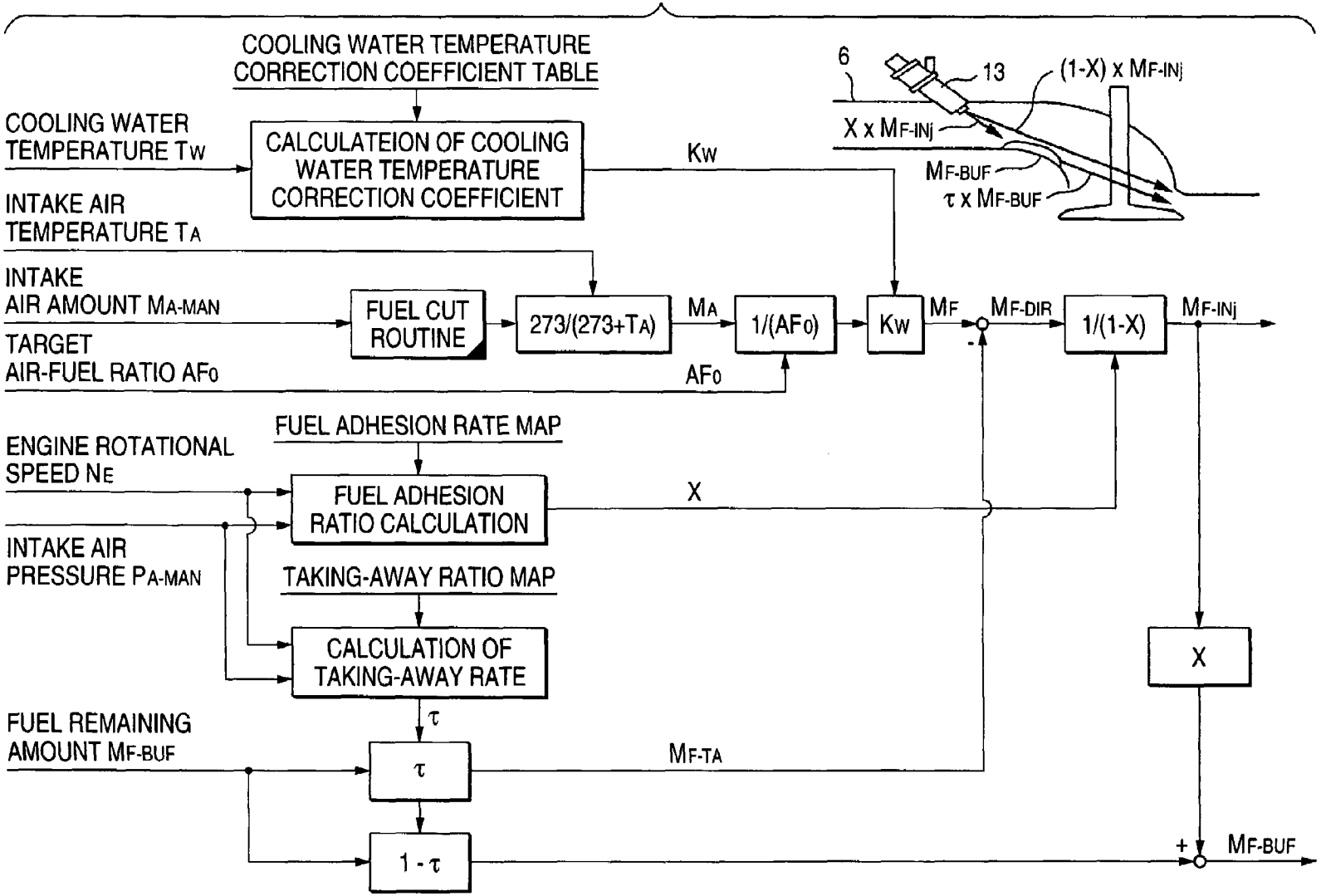
FIG. 7 is a block diagram of a fuel injection amount calculating part and a fuel behavior model.

FIG. 7 illustrates one embodiment of the steady state fuel injection amount calculating part 34 and the fuel behavior model 35. Letting $M_{F\text{-}INJ}$ be the amount of fuel injected from the injector 13 into the intake pipe 6, and X be the rate of the amount of fuel which adheres to the wall of the intake pipe 6 relative to the fuel injection amount $M_{F\text{-}INJ}$, the amount of fuel injected directly into the cylinder out of the fuel injection amount $M_{F\text{-}INJ}$ is $((1-X)\times M_{F\text{-}INJ})$ and the amount of fuel which adheres to the intake pipe wall is $(X\times M_{F\text{-}INJ})$. Some of the fuel which adheres to the intake pipe wall flows along the intake pipe wall into the cylinder. Letting $M_{F\text{-}BUF}$ be the amount of fuel which remains on the intake pipe wall, and the rate of the amount of fuel which is taken away by an air flow relative to the fuel remaining amount $M_{F\text{-}BUF}$ be $\tau$, the amount of fuel which is taken away and flows into the cylinder is $(\tau\times M_{F\text{-}BUF})$.

In one embodiment, in the steady state fuel injection amount calculating part 34, a cooling water correction coefficient $K_w$ is calculated from the cooling water temperature $T_w$, using a cooling water temperature correction coefficient table. The intake air amount $M_{A\text{-}MAN}$ is subjected to a fuel cut routine for cutting fuel when the throttle opening is 0, then is corrected with a flow-in air temperature $T_A$ to obtain an air flow-in amount $M_A$. The air flow-in amount $M_A$ is multiplied by the reciprocal of the target air-fuel ratio $AF_0$, and the result is multiplied by the cooling water temperature correction coefficient $K_w$ to obtain a required fuel flow-in amount $M_F$. Also, the fuel adhesion rate X is obtained from the engine rotational speed $N_E$ and the intake air pressure $P_{A\text{-}MAN}$, using a fuel adhesion rate map. The taking-away rate $\tau$ is obtained from the engine rotational speed $N_E$ and the intake air pressure $P_{A\text{-}MAN}$ using a taking-away rate map. Then, a fuel remaining amount $M_{F\text{-}BUF}$ obtained in the previous calculation is multiplied by the taking-away rate $\tau$ to obtain a fuel taken-away amount $M_{F\text{-}TA}$. A fuel direct flow-in amount $M_{F\text{-}DIR}$ is calculated by subtracting the fuel taken-away amount $M_{F\text{-}TA}$ from the required fuel flow-in amount $M_F$. As described before, since the fuel direct flow-in amount $M_{F\text{-}DIR}$ is (1−X) times the fuel injection amount $M_{F\text{-}INJ}$, the fuel direct flow-in amount $M_{F\text{-}DIR}$ is divided by (1−X) to obtain a steady state fuel injection amount $M_{F\text{-}INJ}$. Since $((1-\tau)\times M_{F\text{-}BUF})$ amount of the fuel left in the intake pipe up to the last time still remains this time, the fuel remaining amount $M_{F\text{-}BUF}$ of this time is obtained by adding the fuel adhesion amount $(X\times M_{F\text{-}INJ})$ thereto.

In one embodiment, the intake air amount calculated in the intake air amount calculating part 28 is detected in the final stage of the intake stroke or the early stage of the following compression stroke of the previous cycle prior to the present cycle, in which an explosion (expansion) stroke is about to start, so the steady state fuel injection amount and fuel injection timing calculated and set by the steady state fuel injection amount calculating part 34 is based on the amount of intake air received during the previous cycle.

In one embodiment, the accelerating state detecting part 41 has an acceleration state threshold value table. The detection of an acceleration state is performed by comparing the difference between the present and previous intake air pressures with a prescribed value which varies according to the crank angle. That is, the threshold value, which is used in detecting an acceleration state by comparing the difference between the present intake air pressure and the intake air pressure at the same crank angle in the same stroke as present, such as an intake or exhaust stroke, in the previous cycle with a prescribed value, varies according to the crank angle. In a preferred embodiment, the detection of an acceleration state is performed after a prescribed number of cycles have been completed since the previous accelerating state is detected.

In a preferred embodiment, the accelerating time fuel injection amount calculating part 42 calculates an accelerating time fuel injection amount $M_{F\text{-}ACC}$ from a three-dimensional map based on the difference between the present and previous intake air pressures, and the engine rotational speed $N_E$, when the accelerating state detecting part 41 detects an acceleration state. In one embodiment, the accelerating fuel injection timing is when the accelerating state detecting part 41 detects an accelerating state. Namely, the accelerating time fuel injection amount $M_{F\text{-}ACC}$ of fuel is injected immediately after an acceleration state is detected.

In one embodiment, the ignition timing setting part 31 includes a basic ignition timing calculating part 36 for calculating basic ignition timing based on an engine rotational speed calculated in the engine rotational speed calculating part 26 and a target air-fuel ratio calculated in the target air-fuel ratio calculating part 33. The ignition timing setting part 31 also includes an ignition timing correction part 38 for correcting the basic ignition timing calculated in the basic ignition timing calculating part 36 based on an accelerating time fuel injection amount calculated in the accelerating time fuel injection amount calculating part 42.

Preferably, the basic ignition timing calculating part 36 obtains the ignition timing when the maximum torque can be generated at the engine rotational speed and the target air-fuel ratio by retrieving a map as basic ignition timing. The basic ignition timing calculated in the basic ignition timing calculating part 36 is based on the result of the intake stroke of the previous cycle, as in the case with the steady state fuel injection amount calculated in the steady state fuel injection amount calculating part 34. The ignition timing correction part 38 obtains the air-fuel ratio in the cylinder at the time when an accelerating time fuel injection amount calculated in the accelerating time fuel injection amount calculating part 42 will be added to the steady state fuel injection amount in response to the calculation of an accelerating time fuel injection amount in the accelerating time fuel injection amount calculating part 42. In one preferred embodiment, when the air-fuel ratio in the cylinder largely differs from the target air-fuel ratio calculated in the steady state target air-fuel ratio calculating part 33, the ignition timing correction part 38 corrects ignition timing by setting new ignition timing using the air-fuel ratio in the cylinder, the engine rotational speed and the intake air pressure.

As described in the embodiments above, the engine control device of the present invention can control the operating condition of the engine using intake air pressures and crank pulses without a cam sensor and a throttle sensor. The crank angle sensor 20, as crank pulse generating means constituted of a magnetic sensor or the like, detects the approach of the teeth 23 as a variation in current. Thus, when the crank angle sensor 20 is close to the teeth 23, the current value becomes large, and when the crank angle sensor 20 is apart from the teeth 23, the current value becomes small. When the current value is binarized with a prescribed value, the crank pulses may be long, or no OFF-part may be generated, when the current value is large. Likewise, the crank pulses may be short, or no ON-part may be generated, when the current value is small. Such a defect is caused by the orientation of the crank angle sensor and the accuracy of the teeth, as well as the relative position of the crank angle sensor relative to the teeth.

Figure 8:
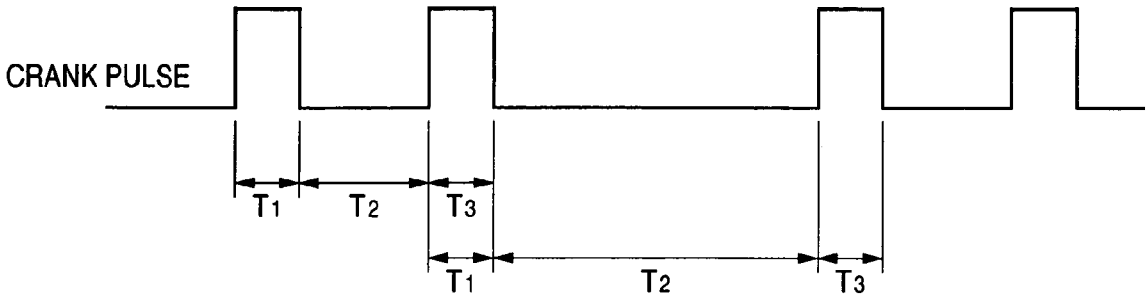
FIG. 8 is an explanatory view illustrating a principle of detecting a standard pitch and an irregular pitch of the crank pulses.

In one embodiment, an irregular interval part (which may be hereinafter referred to as "irregular pitch") corresponding to the missing tooth part, and a regular interval part (which may be hereinafter referred to as "standard pitch"), are detected as follows. As shown in FIG. 8, a crank pulse ratio I is preferably calculated by dividing the width $T_2$ of an OFF-part by the sum of the width $T_1$ of a crank pulse before the OFF-part and the width $T_3$ of a crank pulse after the OFF-part (the width $T_1$ to $T_3$ are represented by time). When the crank pulse ratio I is smaller than a prescribed value $\alpha$, the part is regarded as a standard pitch. Alternatively, when the crank pulse ratio I is larger than the prescribed value $\alpha$, the part is regarded as an irregular pitch. In one preferred embodiment, the judging method can reliably detect an irregular pitch and a standard pitch even when the rotational speed of the crankshaft, namely the engine rotational speed, varies but cannot when the crank pulses are long or short as described before. Thus, in one embodiment, the crank pulse generator generally outputs or generates a number of pulse signals as the crankshaft 3 rotates, wherein the pulse signals occur at the standard pitch between signals. Preferably, the crank pulse generator also produces a pulse signal interruption at a prescribed rotational position of the crankshaft where no pulse signal is outputted, whereby the pitch between the pulse signals immediately before and after the interruption is the irregular pitch, which differs from the standard pitch. Though the frequency of the standard pitch will change with engine speed, the standard pitch will be the same for a given engine operating condition, except that the standard pitch will differ from the irregular pitch at the interruption.

Figure 9:
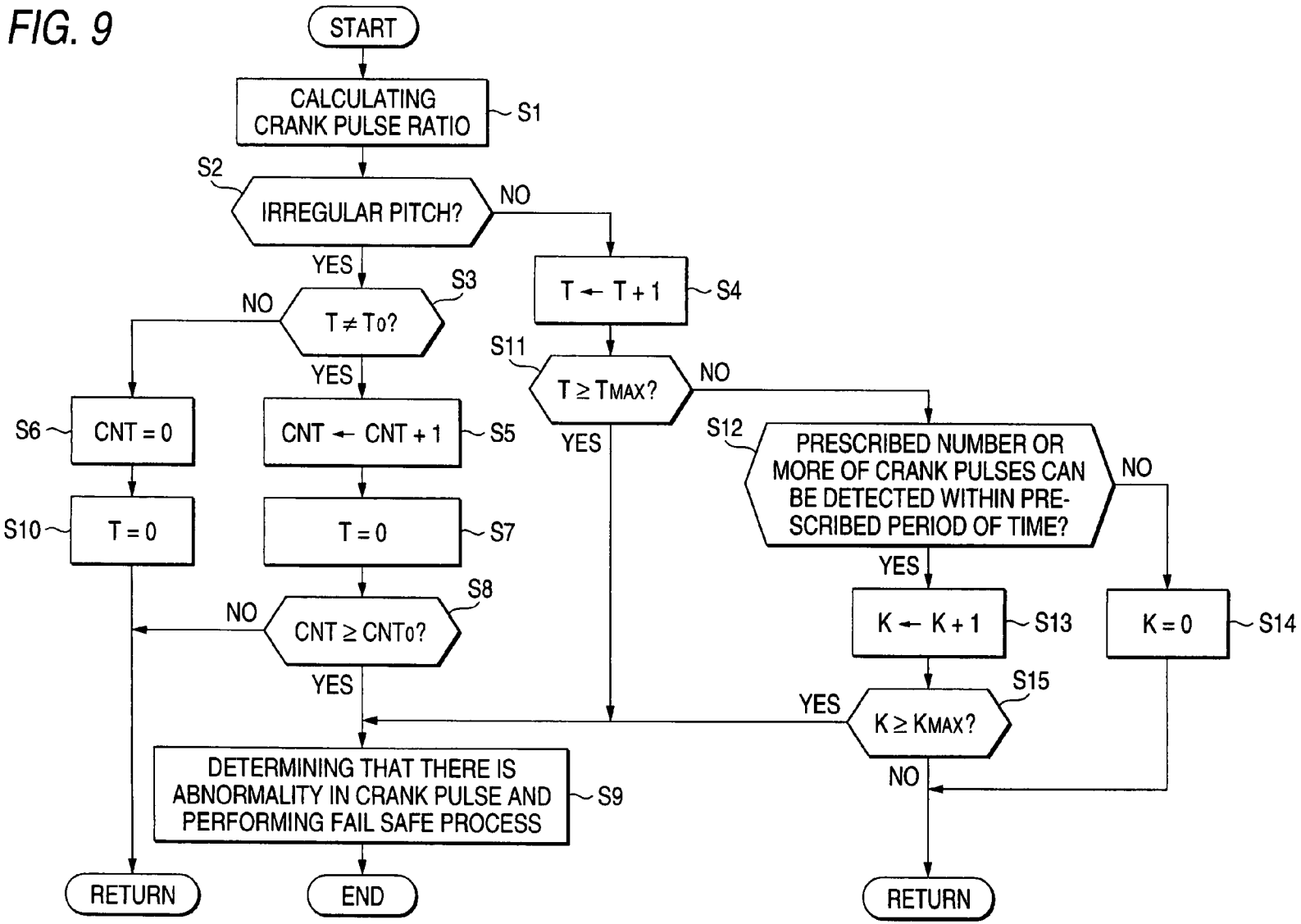
FIG. 9 is a flowchart illustrating an operation for detecting abnormal situations of the crank pulses performed in the engine control unit in FIG. 1, and FIGS. 10(*a*)–(*c*) are explanatory views illustrating different situations of the crank pulses.

Thus, in a preferred embodiment, the engine control unit 15 detects abnormality in crank pulses according to the operation shown in FIG. 9. The device, as discussed above, has built into it an irregular pitch (because of the missing tooth part). Preferably, the operation is performed once per revolution of the crankshaft 3 when the irregular pitch (corresponding to the missing tooth part) is detected. Although there is provided no step for communication in this operation, information necessary for the operation is preferably read as needed and the results of the operation are stored as needed.

As illustrated in FIG. 9, the crank pulse ratio I is calculated in the step S1. Then, the process goes to the step S2, where it is judged whether the crank pulse ratio I calculated in the step 1 is greater than the prescribed value $\alpha$, namely whether the part is an irregular pitch. When it is the missing tooth part, the process goes to the step S3. Otherwise, the process goes to the step S4. In step S3, it is judged whether a crank pulse counter T is not at a prescribed value $T_0$. If the crank pulse counter T is not at the prescribed value $T_0$, the process goes to the step S5. Otherwise, the process goes to the step S6.

As shown in FIG. 9, in the step S5, an interval abnormality counter CNT is incremented. Then, the process goes to the step S7. In the step S7, the crank pulse counter T is cleared to "0". Then, the process goes to the step S8. In the step S8, it is judged whether the interval abnormality counter CNT is at a value which is not smaller than a prescribed value $CNT_0$. If the interval abnormality counter CNT is at a value which is not smaller than the prescribed value $CNT_0$, the process goes to the step S9. Otherwise, the process returns to a main program.

In step S6, the interval abnormality counter CNT is cleared to "0". Then, the process goes to the step S10.

In the step S10, the crank pulse counter T is cleared to "0". Then, the process returns to the main program.

In the step S4, the crank pulse counter T is incremented. Then, the process goes to the step S11.

In the step S11, it is judged whether the crank pulse counter T is at a value which is not smaller than a count-up value $T_{MAX}$. If the crank pulse counter T is at a value which is not smaller than the count-up value $T_{MAX}$, the process goes to the step S9. Otherwise, the process goes to the step S12.

In the step S12, it is judged whether a predetermined prescribed number or more of crank pulses cannot be detected within a predetermined prescribed period of time. If the prescribed number or more of crank pulses cannot be detected within the prescribed period of time, the process goes to the step S13. Otherwise the process goes to the step S14.

In the step S13, a crank pulse undetectable counter K is incremented. Then, the process goes to the step S15.

In the step S15, it is judged whether the crank pulse undetectable counter K is at a value which is not smaller than a count-up value $K_{MAX}$. If the crank pulse undetectable counter K is at a value which is not smaller than the count-up value $K_{MAX}$, the process goes to the step S9. Otherwise, the process returns to the main program.

In the step S14, the crank pulse undetectable counter K is cleared to "0". Then, the process returns to the main program.

In the step S9, it is determined that there is an abnormality in crank pulses and a prescribed fail safe process is performed. Then, the operation is ended. In one embodiment, the fail safe process includes gradually lowering the engine torque by decreasing the frequency of ignition gradually in each cylinder. In another embodiment, the fail safe process includes shifting the ignition in each cylinder to the lag side gradually. In still another embodiment, the fail safe process includes closing the throttle quickly at first and then slowly and an indication of abnormality.

In one embodiment, a fail safe process is performed when the crank pulse counter T, which is incremented in response to standard pitch crank pulses, does not reach the prescribed value $T_0$ before an irregular pitch, namely a specific rotational position of the crankshaft, is detected following the detection of a previous irregular pitch, at least a prescribed value $CNT_0$ times. Preferably, when the crank pulse counter T reaches the count-up value $T_{MAX}$ or greater, in other words, an irregular pitch is not detected for a prescribed period of time for the counter to count up to $T_{MAX}$, it is judged that there is an abnormality in crank pulses and a fail safe process as described before is performed. Also, when the situation in which a prescribed number or more of clank pulses are not detected for a prescribed period of time repeatedly occurs at least the count-up value $K_{MAX}$ of times, it is judged that there is an abnormality in crank pulses and a fail safe process as described before is performed.

Figure 10:
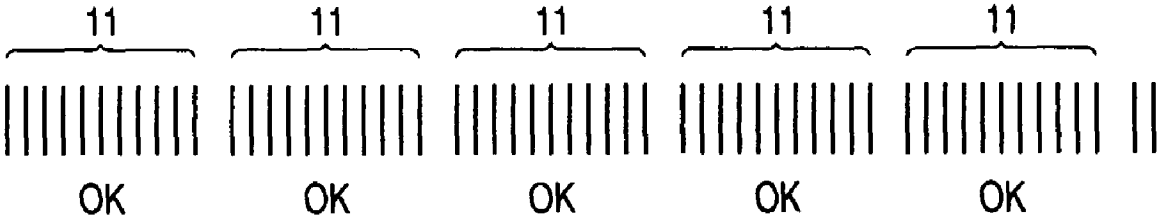
Figure 10:
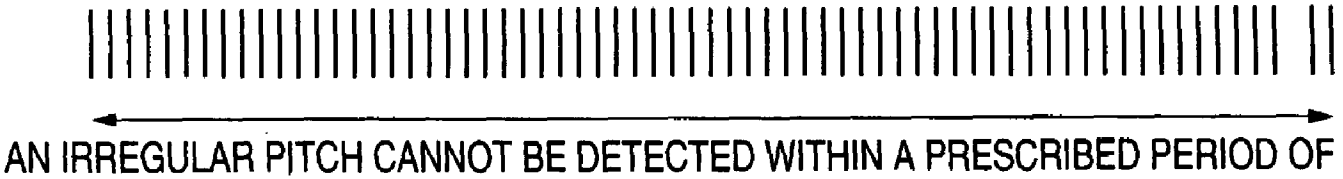
Figure 10:
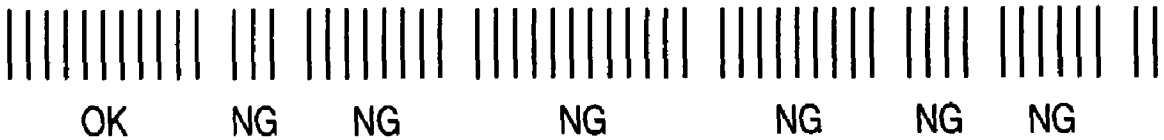

In one embodiment, the correct number of crank pulses between irregular pitches is "11," as shown in FIG. 10*a*. However, there may occur a situation in which no irregular pitch can be detected as shown in FIG. 10*b* (the crank angle sensor is too close to the teeth) or a situation in which the number of crank pulses between irregular pitches are not "11" as shown in FIG. 10*c* (the crank angle sensor is too far from the teeth). According to the operation shown in FIG. 9, both of the situations can be detected as an abnormality in crank pulses. In addition, when a prescribed number or more of crank pulses cannot be detected for a prescribed period of time, although crank pulses can be detected such as when the engine is being started with a kick starter, or such a situation repeatedly occurs at least the count-up value $K_{MAX}$ of times, namely, when the engine does not start to rotate, a fail safe process can be performed (even if the cause is not derived from crank pulses).

In the embodiments above description has been made of an engine of the type in which fuel is injected into an intake pipe. However, the engine control device of the present invention is applicable to an in-cylinder injection engine, namely, a direct injection engine. In a direct injection engine, however, adhesion of fuel to the intake pipe does not occur, so that it is not necessary to take it into consideration and a total amount of fuel to be injected can be used in calculation of an air-fuel ratio.

Additionally, though in the embodiments discussed above description has been made of a multi-cylinder engine having four cylinders, the engine control device of the present invention is applicable to a single-cylinder engine.

Further, one of ordinary skill in the art will recognize that the engine control unit may be an operation circuit instead of the microcomputer.

The various devices, methods and techniques described above provide a number of ways to carry out the invention. Of course, it is to be understood that not necessarily all objectives or advantages described may be achieved in accordance with any particular embodiment described herein. Also, although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. An engine control device comprising:

a crank pulse generator that outputs a number of pulse signals as a crankshaft rotates, said pulse signals occurring at a standard pitch between signals, said generator also producing a pulse signal interruption at a prescribed rotational position of the crankshaft where no pulse signal is outputted, whereby a pitch between the pulse signals immediately before and after said interruption defines an irregular pitch that differs from the standard pitch;

a crankshaft phase detector that detects the pulse signals outputted from said crank pulse generator as crank pulses, detects said irregular pitch, and judges the phase of said crankshaft based on the detected irregular pitch;

an intake air pressure detector for detecting the intake air pressure in an intake pipe of an engine;

an engine controller that controls the operation of said engine based on said phase of the crankshaft and said intake air pressure; and a crank pulse abnormality detector that determines an abnormal position of said crank pulse generator when said irregular pitch is not detected over a prescribed period of time while the crankshaft phase detector continues to detect said crank pulses.

2. The engine control device of claim 1, wherein the crank pulse abnormality detector further determines that the crank pulse generator is at the abnormal position when the number of crank pulses detected by the crankshaft phase detector between the detection of two irregular pitches is not equal to a prescribed value.

3. The engine control device of claim 1, wherein the crank pulse generator is a magnetic sensor.

4. An engine control device comprising:

a crank pulse generator that generally generates pulse signals at a standard pitch between pulses as a crankshaft rotates, said generator interrupting said pulse signal generation once per revolution of the crankshaft at a prescribed rotational location of said crankshaft, whereby a pitch between the pulse signals immediately before and after said interruption defines an irregular pitch that differs from the standard pitch;

a crankshaft phase detector that detects the pulse signals generated by said crank pulse generator in the form of crank pulses, detects said irregular pitch, and gauges the phase of said crankshaft based on the detected irregular pitch;

an intake air pressure detector for detecting the intake air pressure in an intake pipe of an engine;

an engine controller that controls the operation of said engine based on said phase of the crankshaft and said intake air pressure; and a crank pulse abnormality detector that determines an abnormal position of said crank pulse generator.

5. The engine control device of claim 4, wherein the crank pulse abnormality detector determines that the crank pulse generator is in an abnormal position when said irregular pitch is not detected over a prescribed period of time while the crankshaft phase detector continues to detect said crank pulses.

6. A method for controlling the operation of an engine, comprising:

generating a number of pulse signals at a standard pitch between pulse signals as a crankshaft of an engine rotates;

interrupting said pulse signal generation once per revolution of the crankshaft at a prescribed rotational position of said crankshaft, said interruption defining an irregular pitch between pulse signals that occur immediately before and after said interruption, said irregular pitch differing from the standard pitch;

detecting said pulse signals as crank pulses;

detecting said irregular pitch to gauge the phase of the crankshaft;

detecting an intake air pressure in the engine;

controlling the operation of the engine based on said phase of the crankshaft and said intake air pressure; and determining an abnormality when said irregular pitch is not detected over a prescribed period of time while the detection of crank pulses continues.

7. The method of claim 6, further comprising the step of performing a fail safe process upon the determination of said abnormality.

8. The method of claim 7, wherein performing said fail safe process includes gradually lowering an engine torque by gradually decreasing a frequency of ignition in at least one cylinder of said engine.

* * * * *